US008899944B2

(12) United States Patent
Kanai et al.

(10) Patent No.: US 8,899,944 B2
(45) Date of Patent: Dec. 2, 2014

(54) PIEZOELECTRIC MICRO-BLOWER

(75) Inventors: Shungo Kanai, Nagaokakyo (JP); Yoko Kaneda, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 98 days.

(21) Appl. No.: 13/444,913

(22) Filed: Apr. 12, 2012

(65) Prior Publication Data

US 2012/0195774 A1 Aug. 2, 2012

Related U.S. Application Data

(63) Continuation of application No. PCT/JP2010/071541, filed on Dec. 2, 2010.

(30) Foreign Application Priority Data

Dec. 4, 2009 (JP) ..... 2009-277076

(51) Int. Cl.
*F04B 43/04* (2006.01)
*F04B 45/047* (2006.01)

(52) U.S. Cl.
CPC ..... *F04B 45/047* (2013.01); *F04B 43/046* (2013.01)
USPC ..... 417/413.2

(58) Field of Classification Search
USPC ..... 417/413.2, 413.1, 410.2; 977/733, 724; 310/328
See application file for complete search history.

(56) References Cited

U.S. PATENT DOCUMENTS

| | | | | |
|---|---|---|---|---|
| 6,051,911 | A | 4/2000 | Kojima et al. | |
| 2005/0074662 | A1 | 4/2005 | Cho et al. | |
| 2006/0056999 | A1* | 3/2006 | East | 417/413.2 |
| 2006/0201327 | A1 | 9/2006 | Janse Van Rensburg et al. | |
| 2007/0065308 | A1 | 3/2007 | Yamamoto et al. | |
| 2008/0304983 | A1 | 12/2008 | Yamada et al. | |
| 2009/0167109 | A1* | 7/2009 | Tomita et al. | 310/317 |
| 2009/0232682 | A1 | 9/2009 | Hirata et al. | |
| 2009/0232683 | A1* | 9/2009 | Hirata et al. | 417/413.2 |
| 2009/0232684 | A1 | 9/2009 | Hirata et al. | |

FOREIGN PATENT DOCUMENTS

| | | | |
|---|---|---|---|
| CN | 85 1 07669 | A | 11/1986 |
| CN | 1108971 | A | 9/1995 |
| CN | 1833105 | A | 9/2006 |
| CN | 101568728 | A | 10/2009 |
| EP | 0 202 100 | A1 | 11/1986 |
| FR | 2 869 805 | A1 | 11/2005 |
| JP | 2008-303805 | A | 12/2008 |
| JP | 2009-281362 | A | 12/2009 |
| WO | 2008/069266 | A1 | 6/2008 |

OTHER PUBLICATIONS

Official Communication issued in International Patent Application No. PCT/JP2010/071541, mailed on Mar. 8, 2011.

* cited by examiner

*Primary Examiner* — Bryan Lettman
(74) *Attorney, Agent, or Firm* — Keating & Bennett, LLP

(57) ABSTRACT

In a piezoelectric micro-blower, a vibration plate assembly includes a piezoelectric element attached to a diaphragm, with an intermediate plate interposed there between. A blower chamber plate includes a circular opening in a center thereof. A blower chamber defined by the diaphragm, a flow path plate, and the opening of the blower chamber plate is sized to allow internal pressure to be substantially uniformly changed by vibration of the diaphragm. The blower chamber plate and the flow path plate are provided with a first outlet and a second outlet, respectively. Compressive fluid pressurized in the blower chamber is blown out through the first and second outlets.

20 Claims, 12 Drawing Sheets

PIEZOELECTRIC MICRO-BLOWER

BACKGROUND OF THE INVENTION

1. Field of the Invention

The present invention relates to a micro-blower suitable for conveying compressive fluid, such as air.

2. Description of the Related Art

Small electronic devices, such as notebook personal computers and digital AV devices, are equipped with a blower for efficiently removing heat generated inside. It is important and necessary that such a blower for cooling purposes be a small and low-profile blower which consumes less power and has a low noise level.

A piezoelectric micro-blower is disclosed in International Publication No. WO 2008/069266. FIGS. 1A-1E illustrate a cross-sectional structure and an operation of a piezoelectric micro-blower according to International Publication No. WO 2008/069266. The piezoelectric micro-blower includes a blower body 1 and a diaphragm 2 fixed at its periphery to the blower body 1. A piezoelectric element 3 is attached to the center of the backside of the diaphragm 2. A blower chamber 4 is formed between a first wall 1*a* of the blower body 1 and the diaphragm 2. The first wall 1*a* is provided with a first opening 5*a* that faces the center portion of the diaphragm 2.

Applying a voltage to the piezoelectric element 3 causes the diaphragm 2 to bend and change the distance between the first opening 5*a* and the diaphragm 2. The blower body 1 has a second wall 1*b* spaced from the first wall 1*a*. The second wall 1*b* is disposed opposite the blower chamber 4 with the first wall 1*a* interposed therebetween. The second wall 1*b* is provided with a second opening 5*b* that faces the first opening 5*a*. There is an inflow passage 7 between the first wall 1*a* and the second wall 1*b*. The inflow passage 7 leads to the outside at its outer end, and connects to the first opening 5*a* and the second opening 5*b* at its inner end.

FIG. 1A illustrates an initial state in which the diaphragm 2 is flat (i.e., in which no voltage is applied to the piezoelectric element 3). FIG. 1B illustrates the first quarter period of voltage application to the piezoelectric element 3. Since the diaphragm 2 bends downward, the distance between the first opening 5*a* and the diaphragm 2 increases and fluid is drawn through the first opening 5*a* into the blower chamber 4. This causes fluid in the inflow passage 7 to be partially drawn into the blower chamber 4.

In the next quarter period, when the diaphragm 2 returns to a flat state as illustrated in FIG. 1C, the distance between the first opening 5*a* and the diaphragm 2 decreases and the fluid is pushed out upward through the openings 5*a* and 5*b*. The fluid in the inflow passage 7 is drawn into this flow of fluid and flows upward together.

In the next quarter period, since the diaphragm 2 bends upward as illustrated in FIG. 1D, the distance between the first opening 5*a* and the diaphragm 2 decreases and the fluid in the blower chamber 4 is pushed out upward through the openings 5*a* and 5*b* at high speed.

In the next quarter period, when the diaphragm 2 returns to a flat state as illustrated in FIG. 1E, the distance between the first opening 5*a* and the diaphragm 2 increases. This causes fluid to pass through the first opening 5*a* and to be slightly drawn into the blower chamber 4. Because of inertial forces, however, the fluid in the inflow passage 7 continues to flow toward the center and in the direction in which the fluid is pushed out of the blower chamber 4. Then, the diaphragm 2 returns to the state of FIG. 1B and periodically repeats the actions shown in FIG. 1B to FIG. 1E.

In the piezoelectric micro-blower disclosed in International Publication No. WO 2008/069266, the wall that faces the center portion of the diaphragm is provided with the opening through which fluid is discharged. Therefore, the flow of fluid discharged through the opening is orthogonal to the piezoelectric micro-blower body.

However, with the structure from which compressive fluid is blown out in the direction orthogonal to the piezoelectric micro-blower body, even if the piezoelectric micro-blower itself is low profile, incorporating the piezoelectric micro-blower into a small and low-profile electronic device requires a vertical space to accommodate a flow of fluid which is blown out of the piezoelectric micro-blower. To enable fluid to flow horizontally within the housing of the electronic device, it is necessary to place the piezoelectric micro-blower vertically within the housing of the electronic device, or to provide an additional path to convert a vertical flow of discharged fluid into a horizontal flow. Since this eventually requires a vertical space, the piezoelectric micro-blower described above is not suitable for use with low-profile electronic devices.

As a solution to this, a side of the blower chamber of the piezoelectric micro-blower may be provided with an opening which allows fluid to be blown out to the side of the piezoelectric micro-blower body. However, it has been found that, in the piezoelectric micro-blower disclosed in International Publication No. WO 2008/069266 which is driven by a high frequency (e.g., in a barely audible frequency range of 15 kHz or higher or in an ultrasonic range) for prevention of drive noise, even if a side of the blower chamber is provided with an opening, no flow is generated and no fluid can be discharged to the side of the blower chamber.

SUMMARY OF THE INVENTION

In view of the problems described above, preferred embodiments of the present invention provide a piezoelectric micro-blower from which compressive fluid can be blown out to a side of a blower chamber, so that it is possible to significantly reduce the height of space occupied by the piezoelectric micro-blower in a device in which the piezoelectric micro-blower is mounted.

A piezoelectric micro-blower according to a preferred embodiment of the present invention includes a piezoelectric element, a diaphragm to which the piezoelectric element is attached, a diaphragm supporting unit configured to support a periphery of the diaphragm, and a blower chamber configured to change in volume in response to bending of the diaphragm caused by application of a voltage to the piezoelectric element. A side of the diaphragm supporting unit is provided with an outlet that communicates with the blower chamber. The blower chamber is sized to allow internal pressure to be substantially uniformly changed by vibration of the diaphragm in a state where the piezoelectric element is driven by an alternating voltage of about 15 kHz or higher.

With this configuration, the piezoelectric micro-blower described above can be used to blow compressive fluid out to the side thereof.

The blower chamber may be provided, for example, between the diaphragm and the diaphragm supporting unit configured to support the periphery of the diaphragm.

For example, the piezoelectric micro-blower may further include a blower chamber frame sandwiched between the diaphragm and the piezoelectric element. The blower chamber may be defined by the diaphragm, the piezoelectric element, and the blower chamber frame.

According to various preferred embodiments of the present invention, compressive fluid can be blown out to the side of the blower chamber. Therefore, it is possible to significantly reduce the height of space occupied by the piezoelectric micro-blower in the housing of the electronic device in which the piezoelectric micro-blower is mounted.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

A piezoelectric micro-blower according to a first preferred embodiment will be described with reference to FIG. 2 to FIG. 9.

Figure 1A:
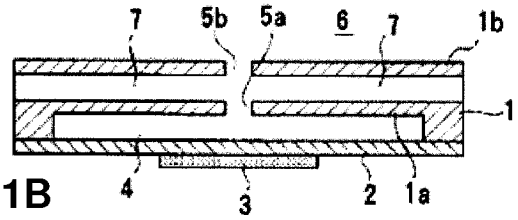
FIG. 1A PRIOR ART
FIGS. 1A-1E illustrates a cross-sectional structure and an operation of a piezoelectric micro-blower according to International Publication No. WO 2008/069266.
Figure 1B:
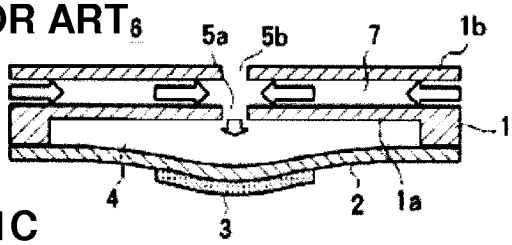
FIG. 1B PRIOR ART
Figure 1C:
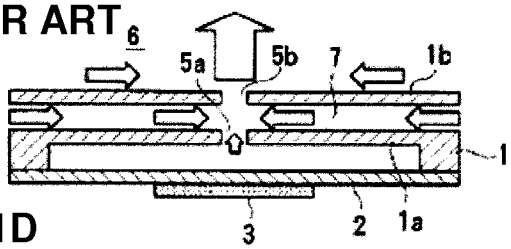
FIG. 1C PRIOR ART
Figure 1D:
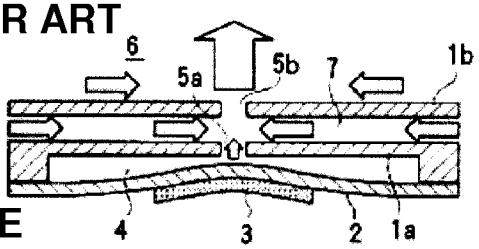
FIG. 1D PRIOR ART
Figure 1E:
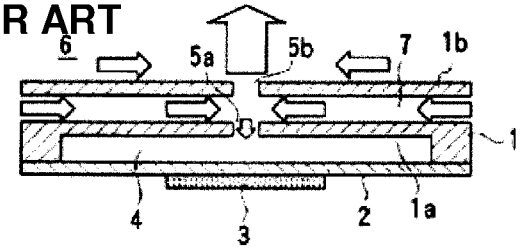
FIG. 1E PRIOR ART
Figure 2:
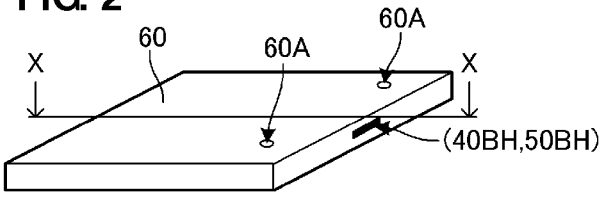
FIG. 2 is a perspective view of a piezoelectric micro-blower 101 according to a first preferred embodiment of the present invention.

FIG. 2 is a perspective view of a piezoelectric micro-blower 101 according to the first preferred embodiment. The piezoelectric micro-blower 101 preferably is substantially square plate-shaped. The piezoelectric micro-blower 101 includes outlets (40BH and 50BH) that are opened in the center of one side thereof. Also, the piezoelectric micro-blower 101 includes inlets which are opened to a principal surface thereof. In the orientation of FIG. 2, inlets 60A appear in the upper surface of the piezoelectric micro-blower 101.

Figure 3:
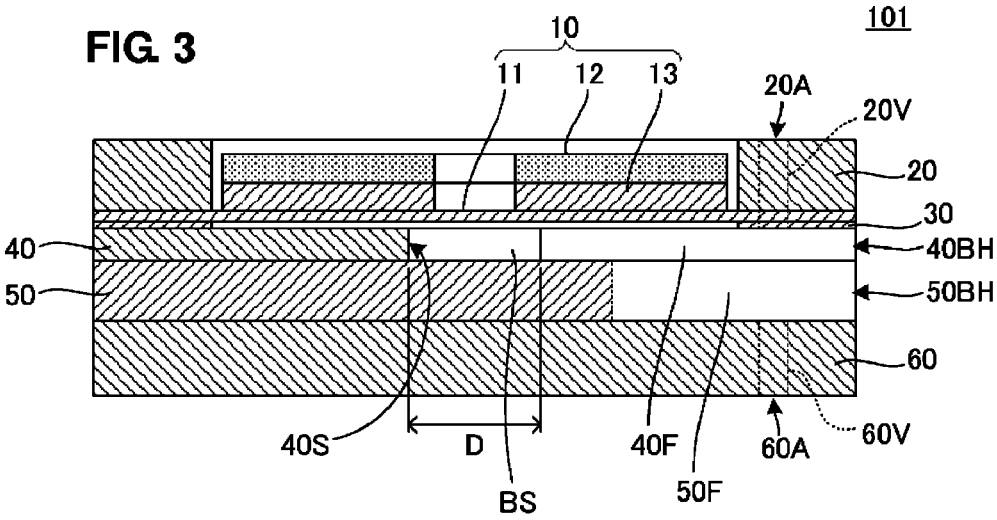
FIG. 3 is a central longitudinal cross-sectional view of the piezoelectric micro-blower 101 taken along line X-X in FIG. 2.

FIG. 3 is a central longitudinal cross-sectional view of the piezoelectric micro-blower 101 taken along line X-X in FIG. 2. For better understanding of the cross-sectional structure, the piezoelectric micro-blower 101 is enlarged in the direction of thickness and the aspect ratio of the piezoelectric micro-blower 101 is changed in FIG. 3. The piezoelectric micro-blower 101 includes a base plate 60, a flow path plate 50, a blower chamber plate 40, a spacer 30, a vibration plate assembly 10, and a side wall plate 20.

The vibration plate assembly 10 is an integral unit that is preferably formed by attaching an annular piezoelectric element 12 to a diaphragm 11, with an annular intermediate plate 13 interposed therebetween. The piezoelectric element 12 and the intermediate plate 13 preferably have the same or substantially the same diameter.

The flow path plate 50, the blower chamber plate 40, the spacer 30, the diaphragm 11, and the side wall plate 20 are provided with holes (not shown) which are opened to allow screws to pass therethrough. The base plate 60 is provided with threaded holes (not shown) into which screws are screwed. The base plate 60, the flow path plate 50, the blower chamber plate 40, the spacer 30, the diaphragm 11, and the side wall plate 20 are integrated preferably by screwing screws from the side wall plate 20 into the threaded holes of the base plate 60.

A circular opening 40S with a diameter D is formed in the center of the blower chamber plate 40. Together with the spacer 30, the vibration plate assembly 10 is sandwiched at the periphery of the diaphragm 11 between the blower chamber plate 40 and the side wall plate 20. In other words, the diaphragm 11 is supported by the blower chamber plate 40 and the side wall plate 20, with the spacer 30 interposed between the blower chamber plate 40 and the diaphragm 11. The spacer 30, the blower chamber plate 40, the flow path plate 50, the base plate 60, and the side wall plate 20 correspond to a "diaphragm supporting unit" according to a preferred embodiment of the present invention.

A blower chamber BS is a space surrounded by the diaphragm 11, the flow path plate 50, and the opening 40S of the blower chamber plate 40.

The blower chamber plate 40 is provided with the outlet 40BH. And the flow path plate 50 is provided with the outlet 50BH. Outlet flow path 40F is provided between the blower chamber BS and the outlets 40BH. Outlet flow path 50F is provided between the blower chamber BS and the outlets 50BH.

The side wall plate 20 includes a vertical hole 20V across the thickness thereof. The diaphragm 11 and the spacer 30 each include a hole that communicates with the vertical hole 20V and leads to the middle of the outlet flow path 40F. One end of the vertical hole 20V is opened at an inlet 20A. The base plate includes a vertical hole 60V across the thickness thereof. The vertical hole 60V leads to the middle of the outlet flow path 50F. One end of the vertical hole 60V is opened at an inlet 60A.

Compressive fluid pressurized in the blower chamber BS (hereinafter, air will be described as an example of the compressive fluid) passes through the outlet flow paths 40F and 50F and is blown out through the outlets 40BH and 50BH. This causes air to be drawn into the inlets 20A and 60A. The air drawn in is blown out through the outlets 40BH and 50BH, together with air from the blower chamber BS. Thus, components disposed adjacent to the outlets 40BH and 50BH of the piezoelectric micro-blower 101 can be cooled down.

FIG. 4 is a plan view of each component member of the piezoelectric micro-blower 101 illustrated in FIG. 2 and FIG. 3. As illustrated in FIG. 4A, the side wall plate 20 preferably is square plate-shaped and includes a circular opening 20S in the center thereof. The circular opening 20S is arranged to support only the periphery of the diaphragm 11. The side wall plate 20 includes two vertical holes 20V. As described above, the vertical holes 20V constitute a portion of an inlet flow path.

Figure 4A:
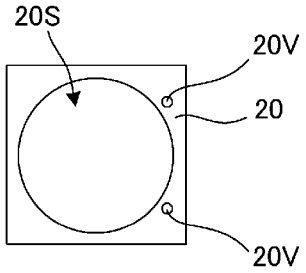
FIGS. 4A-4G are plan views of each component member of the piezoelectric micro-blower 101 illustrated in FIG. 2 and FIG. 3.
Figure 4B:
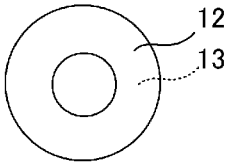

As illustrated in FIG. 4B, both the piezoelectric element 12 and the intermediate plate 13 preferably are annular plate-shaped.

Figure 4C:
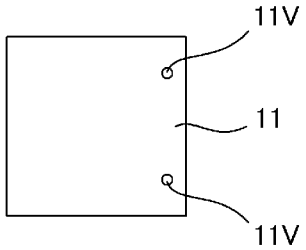

As illustrated in FIG. 4C, the diaphragm 11 preferably is square plate-shaped and includes two holes 11V, which communicate with the respective vertical holes 20V of the side wall plate.

Figure 4D:
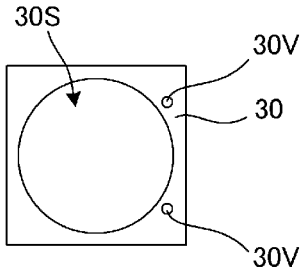

As illustrated in FIG. 4D, the spacer 30 preferably is square plate-shaped and includes a circular opening 30S in the center thereof. The spacer 30 includes two holes 30V, which communicate with the respective holes 11V of the diaphragm 11. The spacer 30 and the side wall plate 20 preferably have the same or substantially the same shape in plan view.

Figure 4E:
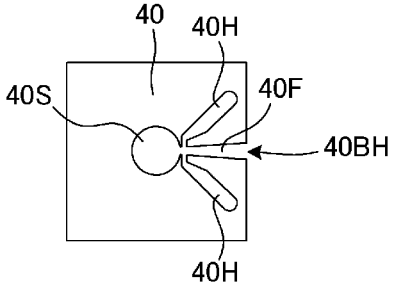

As illustrated in FIG. 4E, the blower chamber plate 40 preferably is square plate-shaped and includes the circular opening 40S in the center thereof. The blower chamber plate 40 includes two horizontal holes 40H and the outlet flow path 40F. The outlet flow path 40F allows communication between the opening 40S and the outlet 40BH.

First ends of the respective horizontal holes 40H connect to a base portion of the outlet flow path 40F (at a position adjacent to the opening 40S). Second ends of the respective horizontal holes 40H communicate with the respective holes 30V of the spacer 30. The holes 30V of the spacer 30 communicate with the respective holes 11V of the diaphragm 11 and with the respective vertical holes 20V of the side wall plate 20. This means that the second ends of the horizontal holes 40H communicate with the respective inlets 20A illustrated in FIG. 3.

Figure 4F:
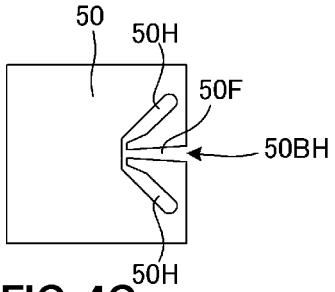

As illustrated in FIG. 4F, the flow path plate 50 preferably is square plate-shaped and includes two horizontal holes 50H and the outlet flow path 50F. The two horizontal holes 50H and the outlet flow path 50F are preferably identical in shape to, and coincide with, the corresponding two horizontal holes 40H and outlet flow path 40F of the blower chamber plate 40. With the addition of the horizontal holes 50H and the outlet flow path 50F in the flow path plate 50, the thickness of horizontal holes and outlet flow paths can be increased.

The outlet flow paths 40F and 50F and the outlets 40BH and 50BH define an outlet nozzle. By the action of this nozzle, air blown out of the blower chamber can be rectified to flow in a certain direction, and control is performed such that a change in pressure from the blower chamber to the outlets 40BH and 50BH can take place in a predetermined pattern. In the conventional blower from which fluid is vertically blown out, adding a nozzle thereto may increase the height of the piezoelectric micro-blower 101. In contrast, the structure of the present preferred embodiment can be realized without an increase in size, because a nozzle can be provided in the outlet flow paths for the blower chamber or in the base plate.

Figure 4G:
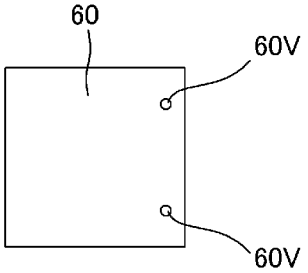
Figure 5A:
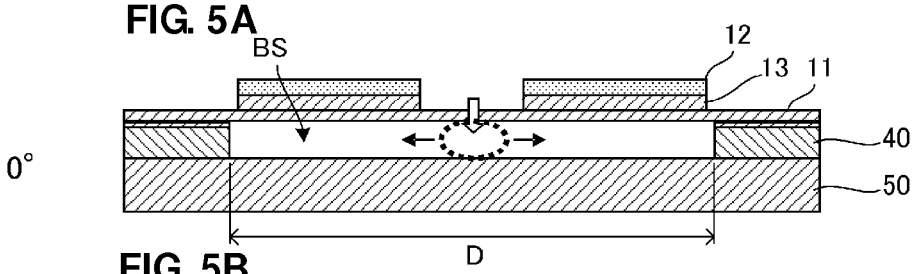
FIGS. 5A-5D illustrate an example where a diameter D of a blower chamber is larger than a wavelength of a pressure wave generated in the blower chamber.
Figure 5B:
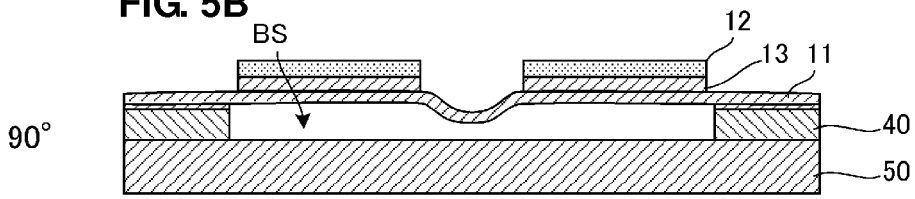
Figure 5C:
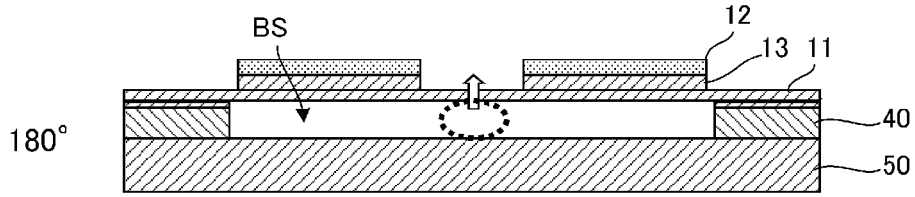
Figure 5D:
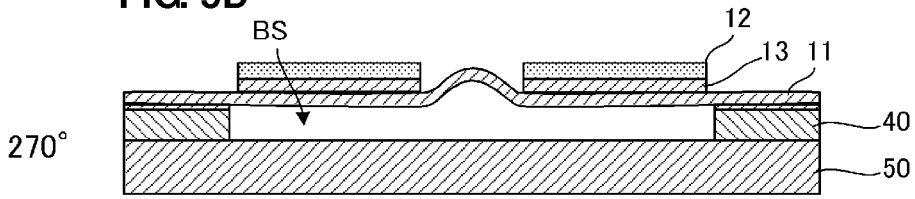
Figure 6A:
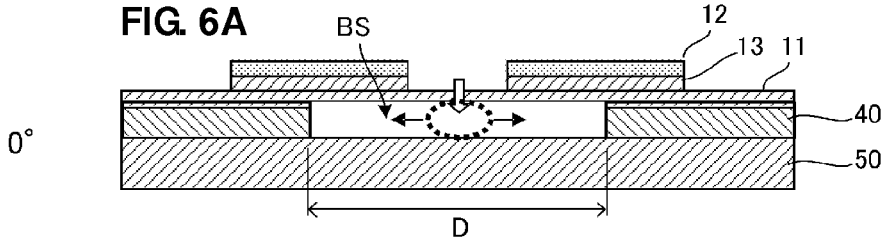
FIGS. 6A-6D illustrate an example where a diameter D of a blower chamber is half a wavelength of a pressure wave generated in the blower chamber.
Figure 6B:
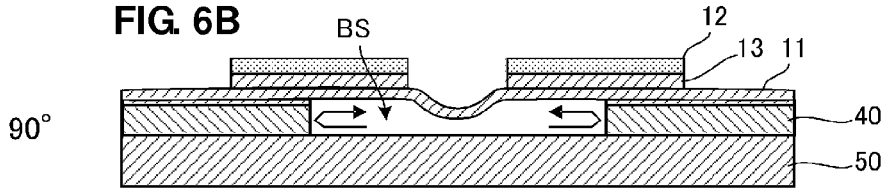
Figure 6C:
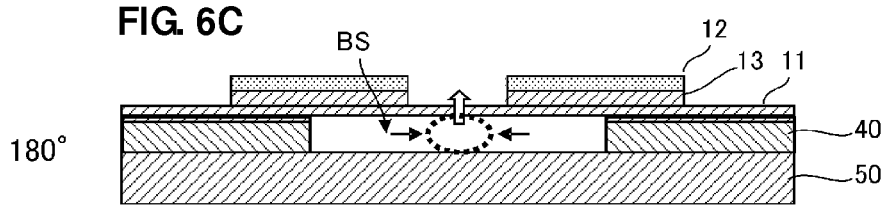
Figure 6D:
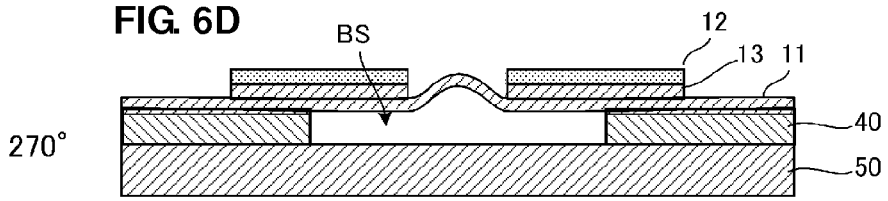
Figure 7:
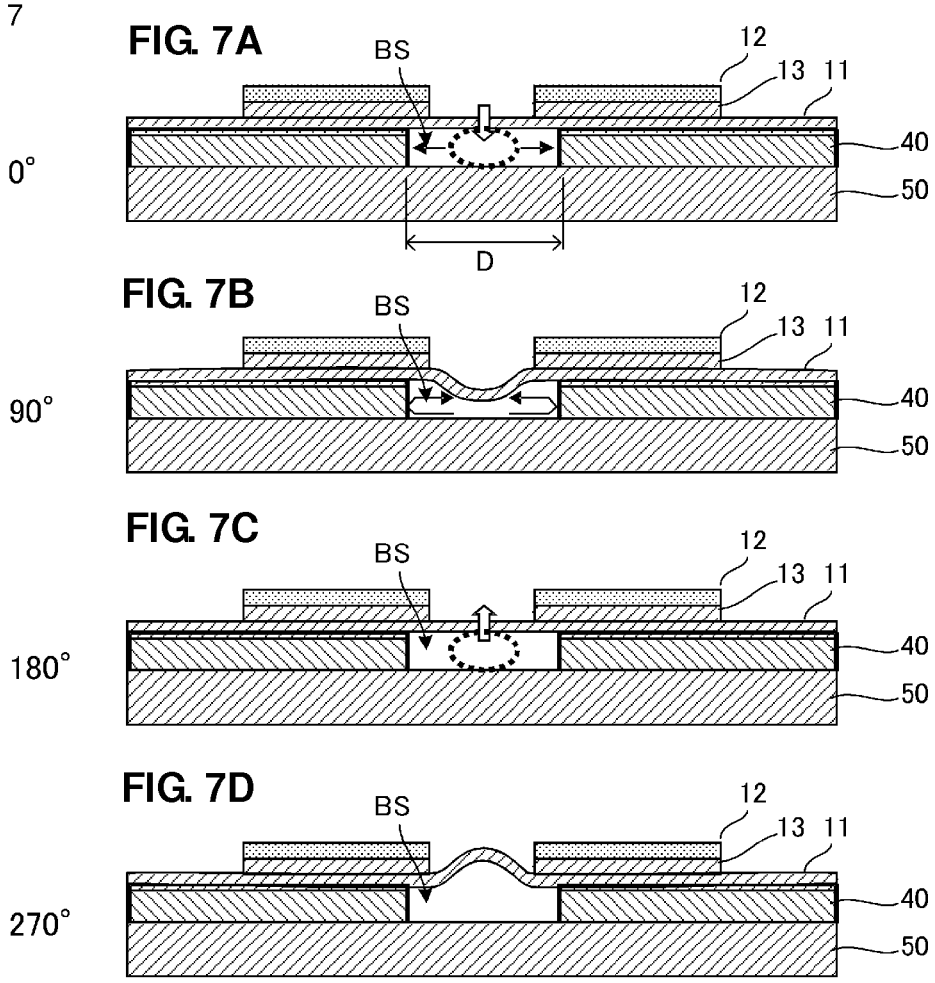
FIGS. 7A-7D illustrate an example where a diameter D of a blower chamber is a quarter of a wavelength of a pressure wave generated in the blower chamber.

As illustrated in FIG. 4G, the base plate 60 preferably is square plate-shaped and includes two vertical holes 60V, which communicate with the respective horizontal holes 50H of the flow path plate 50.

The piezoelectric micro-blower 101 illustrated in FIG. 3 can be obtained by stacking the component members illustrated in FIGS. 4A-4G and fastening them with screws. Although the component members are fastened with screws here, they may be integrated by bonding, caulking, or other means.

FIG. 5A to FIG. 7D each illustrate a relationship between a size of the blower chamber BS of the piezoelectric micro-blower 101 and a change in pressure in the blower chamber BS. Note that only components necessary for the description are presented in the drawings in a simplified manner. FIG. 5A to FIG. 7D illustrate a third-order vibration mode in which bending vibration occurs at the third harmonic which allows only a portion of the diaphragm 11 corresponding to an inside diameter of the annular piezoelectric element 12 and intermediate plate 13 to be significantly displaced.

FIGS. 5A-5D illustrate an example where the diameter D of the blower chamber is larger than a wavelength of a pressure wave generated in the blower chamber. Note that FIGS. 5A-5D illustrate a pressure wave and a change in the diaphragm 11 and the blower chamber BS for every 90° phase difference in the vibration cycle of the diaphragm 11.

First, at a phase of 0°, the diaphragm 11 is in the middle of displacement from the previous position at a phase of 270°, in the direction of contraction of the blower chamber BS. At a phase of 0°, the displacement of the diaphragm 11 is zero and the velocity is maximum. An open arrow in the drawing indicates the direction of displacement of the diaphragm 11. Because of the high velocity of displacement of the diaphragm 11, pressure at the center of the diaphragm 11 is higher than atmospheric pressure. A dashed ellipse in the drawing indicates that pressure is high in the enclosed region. A pressure wave propagates from this region of high pressure toward the periphery of the diaphragm 11. Arrows in the drawing indicate this propagation.

Subsequently, the diaphragm 11 is displaced in the direction of contraction of the blower chamber BS. At a phase of 90°, the displacement of the diaphragm 11 is maximum and the velocity is zero.

Next, the diaphragm 11 is displaced in the direction of expansion of the blower chamber BS. At a phase of 180°, the displacement of the diaphragm 11 is zero and the velocity is maximum. At this point, pressure at the center of the blower chamber BS is lower than atmospheric pressure. An open arrow in the drawing indicates the direction of displacement of the diaphragm 11. A dashed ellipse in the drawing indicates that pressure is low in the enclosed region.

Then, the diaphragm 11 is displaced in the direction of expansion of the blower chamber BS. At a phase of 270°, the displacement of the diaphragm 11 is maximum and the velocity is zero.

The above-described actions are repeated. At around a phase of 0° illustrated in FIG. 5A, a pressure wave generated at the center of the blower chamber BS propagates toward the periphery of the blower chamber BS. In the example illustrated in FIGS. 5A-5D, where the diameter D of the blower chamber BS is larger than the wavelength of a pressure wave generated in the blower chamber BS, the pressure wave attenuates as it propagates toward the periphery of the blower chamber BS. Therefore, although a change in pressure at the center of the blower chamber BS is large, a change in pressure at the periphery of the blower chamber is small. With this size of the blower chamber, air cannot be blown out from the side of the blower chamber.

FIGS. 6A-6D illustrate an example where the diameter D of the blower chamber is half a wavelength of a pressure wave generated in the blower chamber. Note that FIGS. 6A-6D illustrate a pressure wave and a change in the diaphragm 11 and the blower chamber BS for every 90° phase difference in the vibration cycle of the diaphragm 11.

First, at a phase of 0°, the diaphragm 11 is in the middle of displacement from the previous position at a phase of 270°, in the direction of contraction of the blower chamber BS. As in the case of FIG. 5A, the displacement of the diaphragm 11 is zero and the velocity is maximum at a phase of 0°. Because of the high velocity of displacement of the diaphragm 11, pressure at the center of the diaphragm 11 is higher than atmospheric pressure. From this region of high pressure, a pressure wave propagates toward the periphery of the diaphragm 11.

Subsequently, the diaphragm 11 is displaced in the direction of contraction of the blower chamber BS. At a phase of 90°, the displacement of the diaphragm 11 is maximum and the velocity is zero. Since the radius (D/2) of the blower chamber BS is a quarter of a wavelength, the pressure wave generated at the center of the blower chamber at a phase of 0° is reflected off the inner wall of the opening 40S of the blower chamber plate 40 after a quarter of a period.

Next, the diaphragm 11 is displaced in the direction of expansion of the blower chamber BS. At a phase of 180°, the displacement of the diaphragm 11 is zero and the velocity is maximum. At this point, pressure at the center of the blower chamber BS tries to decrease in accordance with the displacement of the diaphragm 11. However, the pressure wave reflected off the inner wall of the opening 40S of the blower chamber plate 40 back to the center of the blower chamber BS acts to cancel out the change in pressure at the center of the blower chamber.

Then, the diaphragm 11 is displaced in the direction of expansion of the blower chamber BS. At a phase of 270°, the displacement of the diaphragm 11 is maximum and the velocity is zero. At this point, pressure at the center of the blower chamber BS is equal to atmospheric pressure or less.

The above-described actions are repeated. As described above, the pressure wave generated at the center of the blower chamber BS by the displacement of the diaphragm 11 propagates toward the periphery of the blower chamber BS, reflects off the inner wall of the opening 40S of the blower chamber plate 40, travels back to the center of the blower chamber BS, and brings about interference. In the example illustrated in FIGS. 6A-6D, where the diameter D of the blower chamber BS is half the wavelength of a pressure wave generated in the blower chamber BS, a pressure wave reflected off the inner wall of the opening 40S of the blower chamber plate 40 back to the center of the blower chamber BS and a pressure wave generated at the center of the blower chamber BS interfere with each other in reverse phase and cancel out each other's pressure. Therefore, the diaphragm 11 cannot effectively change the pressure in the blower chamber. The blower chamber BS is small in size and there is less attenuation during the propagation toward the periphery of the blower chamber BS. However, even with this size of the blower chamber, air cannot be sufficiently blown out from the side of the blower chamber.

FIGS. 7A-7D illustrate an example where the diameter D of the blower chamber is a quarter of a wavelength of a pressure wave generated in the blower chamber. Note that FIGS. 7A-7D illustrate a pressure wave and a change in the diaphragm 11 and the blower chamber BS for every 90° phase difference in the vibration cycle of the diaphragm 11.

First, at a phase of 0°, the diaphragm 11 is in the middle of displacement from the previous position at a phase of 270°, in the direction of contraction of the blower chamber BS. As in the case of FIG. 5A, the displacement of the diaphragm 11 is zero and the velocity is maximum at a phase of 0°. Because of the high velocity of displacement of the diaphragm 11, pressure at the center of the diaphragm 11 is higher than atmospheric pressure. From this region of high pressure, a pressure wave propagates toward the periphery of the diaphragm 11.

Subsequently, the diaphragm 11 is displaced in the direction of contraction of the blower chamber BS. At a phase of 90°, the displacement of the diaphragm 11 is maximum and the velocity is zero. The radius (D/2) of the blower chamber BS is one-eighth of a wavelength. Therefore, when the pressure wave generated at the center of the blower chamber at a phase of 0° is reflected off the inner wall of the opening 40S of the blower chamber plate 40 after one-eighth of a period and travels back to the center of the blower chamber after a quarter of a period, a region of high pressure and a region of low pressure do not coincide at the same point in time.

Next, the diaphragm 11 is displaced in the direction of expansion of the blower chamber BS. At a phase of 180°, the displacement of the diaphragm 11 is zero and the velocity is maximum.

Then, the diaphragm 11 is displaced in the direction of expansion of the blower chamber BS. At a phase of 270°, the displacement of the diaphragm 11 is maximum and the velocity is zero. At this point, pressure at the center of the blower chamber BS is equal to atmospheric pressure or less.

The above-described actions are repeated.

As described above, the pressure wave generated at the center of the blower chamber BS by the displacement of the diaphragm 11 propagates toward the periphery of the blower chamber BS, reflects off the inner wall of the opening 40S of the blower chamber plate 40, and immediately travels back to the center of the blower chamber BS. In the example illustrated in FIGS. 7A-7D, where the diameter D of the blower chamber BS is a quarter of the wavelength of a pressure wave generated in the blower chamber BS, a pressure wave reflected off the inner wall of the opening 40S of the blower chamber plate 40 back to the center of the blower chamber BS and a pressure wave generated at the center of the blower chamber BS do not cancel out each other. This allows a substantially uniform change in pressure in the blower chamber BS. Thus, the pressure at the periphery of the blower chamber significantly changes in the same manner as that at the center of the blower chamber, so that air can be blown out from the side of the blower chamber. In this example, the diameter D of the blower chamber BS is preferably a quarter of the wavelength of a pressure wave generated in the blower chamber BS. As long as the diameter D is a quarter of the wavelength or less, the pressure waves described above do not cancel out each other. The smaller the diameter D, the faster the pressure wave propagates and the more uniformly the pressure changes.

Figure 8:
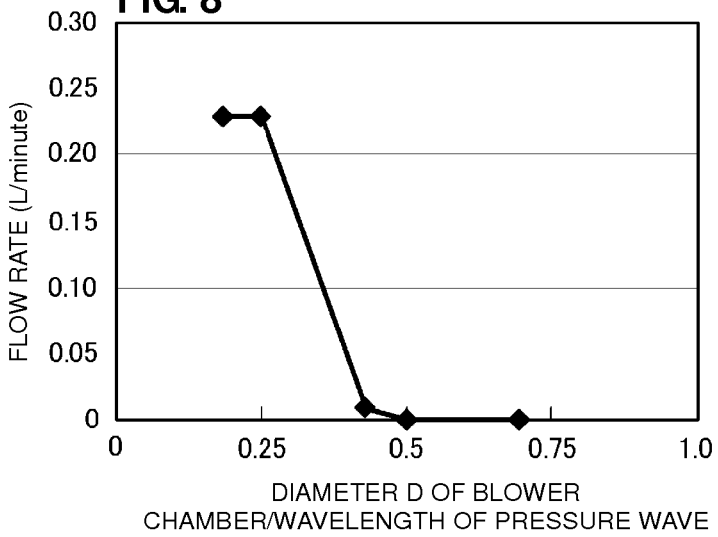
FIG. 8 illustrates a relationship between a diameter D of a blower chamber BS and a flow rate of air blown out of the piezoelectric micro-blower 101.

FIG. 8 illustrates a relationship between the diameter D of the blower chamber BS and a flow rate of air blown out of the piezoelectric micro-blower 101. The horizontal axis represents the ratio of the diameter D of the blower chamber BS to the wavelength of a pressure wave (sound wave propagating through a medium) at a drive frequency. The velocity of sound at the room temperature was determined to be about 340 m, and the wavelength of a pressure wave (sound wave) generated in the blower chamber at the drive frequency was calculated to determine the ratio of the diameter D of the blower chamber BS to the calculated wavelength.

Non-limiting examples of dimensions of the piezoelectric micro-blower 101 are as follows.

Piezoelectric element 12
- Thickness: 0.2 (mm)
- Outside diameter: 12 (mm)
- Inside diameter: 5 (mm)

Intermediate plate 13
- Thickness: 0.1 (mm)
- Outside diameter: 12 (mm)
- Inside diameter: 5 (mm)

Diaphragm 11
- Thickness: 0.08 (mm)
- Outside diameter: 15 (mm)

Blower chamber plate 40
- Thickness: 0.2 (mm)
- Inside diameter: 3 to 11 (mm)

Flow path plate 50
- Thickness: 0.5 (mm)

Base plate 60
- Thickness: 0.5 (mm)

Drive voltage applied to piezoelectric element 12
- Frequency: 20 kHz

Alternating current voltage: 50 Vpp

When the diameter D was less than about 0.5, that is, when the diameter D was less than half the wavelength of a pressure wave, the flow rate of lateral blow began to be obtained. When the diameter D was about 0.25 or less, that is, when the diameter D was less than or equal to a quarter of the wavelength of a pressure wave, the flow rate was about 0.23 (L/minute) and a large amount of air was blown out.

When the diameter D of the blower chamber BS is less than or equal to a quarter of the wavelength of a pressure wave generated in the blower chamber BS, or, the more the diameter D is smaller than a quarter of the wavelength, the faster the pressure wave reflects off the inner wall of the opening 40S of the blower chamber plate 40 back to the center of the blower chamber BS. Thus, the faster the pressure wave propagates, the more uniformly the pressure in the blower chamber changes. However, note that if the diameter D of the blower chamber BS is too small, the displacement of the diaphragm 11 and the amount of change in volume of the blower chamber are reduced, and hence the flow rate will be reduced. Therefore, the diameter D of the blower chamber BS can be set to a value which provides a predetermined flow rate while satisfying the condition that it does not exceed a quarter of the wavelength of a pressure wave generated in the blower chamber BS. In this case, by increasing the size of a driven portion of the diaphragm 11 while maintaining the small size of the blower chamber as in the first preferred embodiment, it is possible to achieve a uniform pressure distribution in the blower chamber while increasing the displacement, and thus to achieve good flow rate performance.

The experimental results have shown that when the diameter D of the blower chamber BS is less than about half the wavelength of a pressure wave, air is blown out from a side of the blower chamber. Theoretically, pressures may begin to cancel out each other if the diameter D is in the range described above. However, the pressures do not completely cancel out each other because some force acts to provide a uniform pressure distribution.

Figure 9:
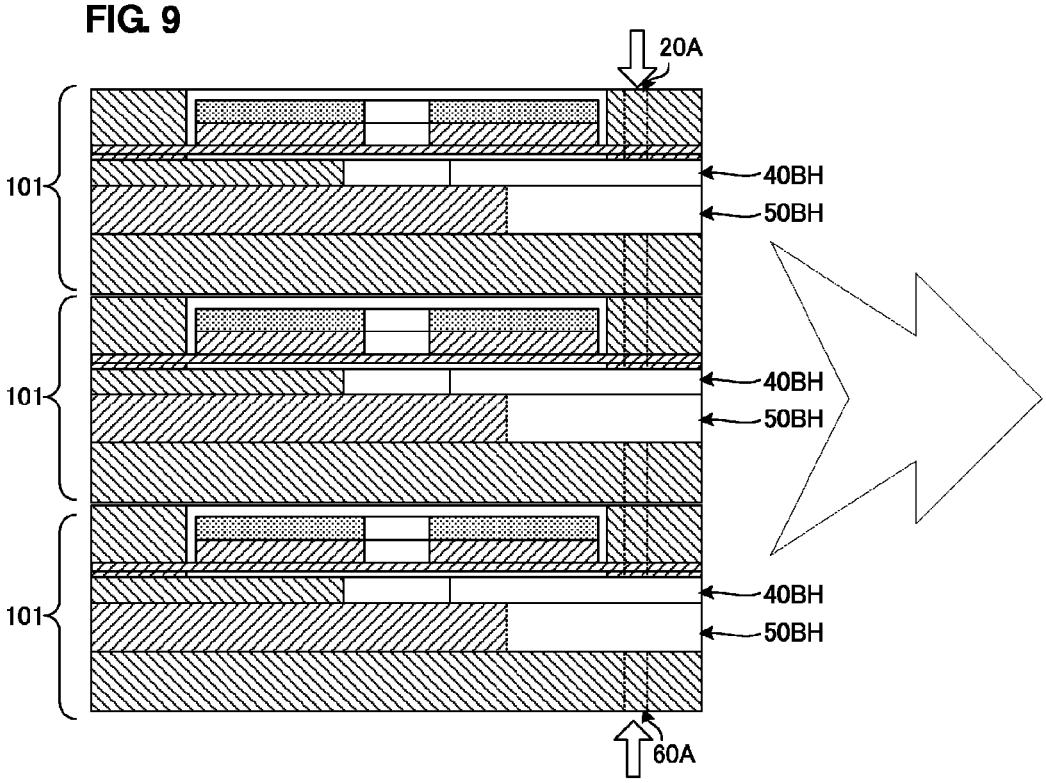
FIG. 9 is a cross-sectional view illustrating an application where piezoelectric micro-blowers 101 of the first preferred embodiment are stacked in three tiers.

FIG. 9 is a cross-sectional view illustrating an application where piezoelectric micro-blowers 101 of the first preferred embodiment are preferably stacked in three tiers. In the piezoelectric micro-blower 101 of the first preferred embodiment, the inlets 20A and 60A in the upper and lower sides thereof coincide with each other in plan view. This means that when a plurality of piezoelectric micro-blowers 101 are stacked, the inlets 20A and 60A of the piezoelectric micro-blowers 101 communicate with one another. Thus, each of the piezoelectric micro-blowers 101 operates properly and increases the overall flow rate of blown-out air. Moreover, since the outlets 40BH and 50BH are arranged in the same plane and face in the same direction, air blown out through the outlets 40BH and 50BH draws in the surrounding air, so that the overall flow rate of air can be further increased.

Second Preferred Embodiment

Figure 10:
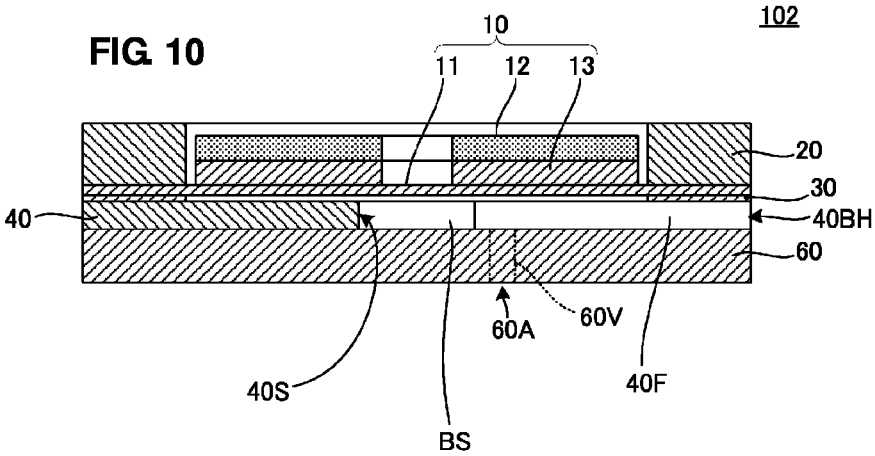
FIG. 10 is a cross-sectional view of a piezoelectric micro-blower 102 according to a second preferred embodiment of the present invention.

FIG. 10 is a cross-sectional view of a piezoelectric micro-blower 102 according to a second preferred embodiment of the present invention. The differences from the piezoelectric micro-blower 101 according to the first preferred embodiment are that the piezoelectric micro-blower 102 does not include the flow path plate 50 illustrated in FIG. 3, and that the piezoelectric micro-blower 102 has only one inlet 60A.

Figure 11A:
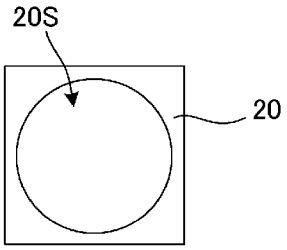
FIGS. 11A-11F are plan views of each component member of the piezoelectric micro-blower 102 illustrated in FIG. 10.

FIGS. 11A-11F are plan views of component members of the piezoelectric micro-blower 102 illustrated in FIG. 10. As illustrated in FIG. 11A, the side wall plate 20 preferably is square plate-shaped and includes the circular opening 20S in the center thereof.

Figure 11B:
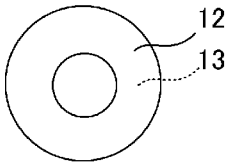

As illustrated in FIG. 11B, both the piezoelectric element 12 and the intermediate plate 13 preferably are annular plate-shaped.

Figure 11C:
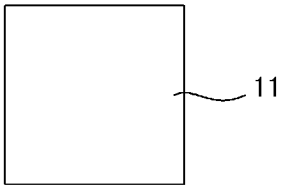

As illustrated in FIG. 11C, the diaphragm 11 preferably is square plate-shaped.

Figure 11D:
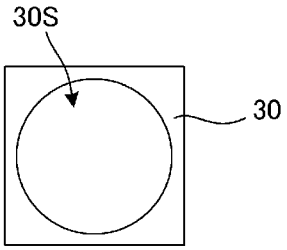

As illustrated in FIG. 11D, the spacer 30 preferably is square plate-shaped and includes the circular opening 30S in the center thereof.

Figure 11E:
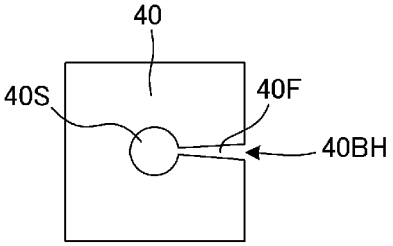

As illustrated in FIG. 11E, the blower chamber plate 40 is square plate-shaped and includes the circular opening 40S in the center thereof. The blower chamber plate 40 includes the outlet flow path 40F. The outlet flow path 40F allows communication between the opening 40S and the outlet 40BH.

Figure 11F:
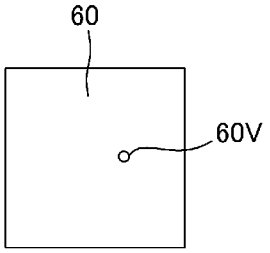

As illustrated in FIG. 11F, the base plate 60 preferably is square plate-shaped and includes one vertical hole 60V. The vertical hole 60V connects to a base portion of the outlet flow path 40F (at a position adjacent to the opening 40S) of the blower chamber plate 40.

The piezoelectric micro-blower 102 illustrated in FIG. 10 can be obtained by stacking the component members illustrated in FIGS. 11A-11F and fastening them with screws.

Third Preferred Embodiment

Figure 12:
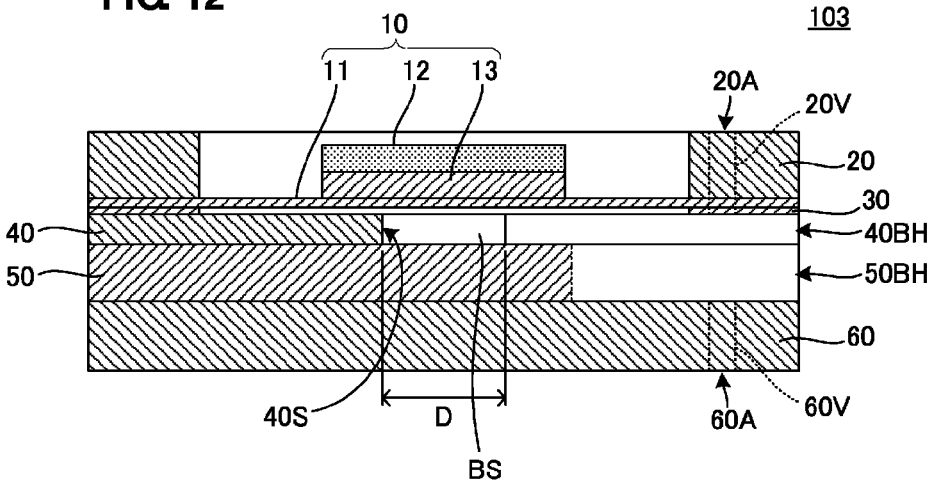
FIG. 12 is a cross-sectional view of a piezoelectric micro-blower 103 according to a third preferred embodiment of the present invention.

FIG. 12 is a cross-sectional view of a piezoelectric micro-blower 103 according to a third preferred embodiment of the present invention. The difference from the piezoelectric micro-blower 101 according to the first preferred embodiment is that the piezoelectric element 12 and the intermediate plate 13 preferably have a disk shape. The other configurations are preferably the same as those of the piezoelectric micro-blower 101. The piezoelectric micro-blower 103 may be used in the first-order vibration mode. The piezoelectric micro-blower 103 can be made much smaller in size than the piezoelectric micro-blower 101 of the first preferred embodiment.

Although the vibration mode of the vibration plate assembly 10 including the diaphragm 11, the piezoelectric element 12, and the intermediate plate 13 is different from that described in the first preferred embodiment, the size of the blower chamber BS and the conditions for a uniform change in pressure within the blower chamber are the same as those described in the first preferred embodiment. Therefore, the present invention is also applicable to a piezoelectric micro-blower which includes such a disk-shaped piezoelectric element. That is, with the structure of the blower chamber according to the present invention, it is possible to achieve a substantially uniform change in internal pressure and obtain similar effects, regardless of the vibration mode and the configuration, such as the presence of the diaphragm, piezoelectric element, and intermediate plate.

Fourth Preferred Embodiment

Figure 13:
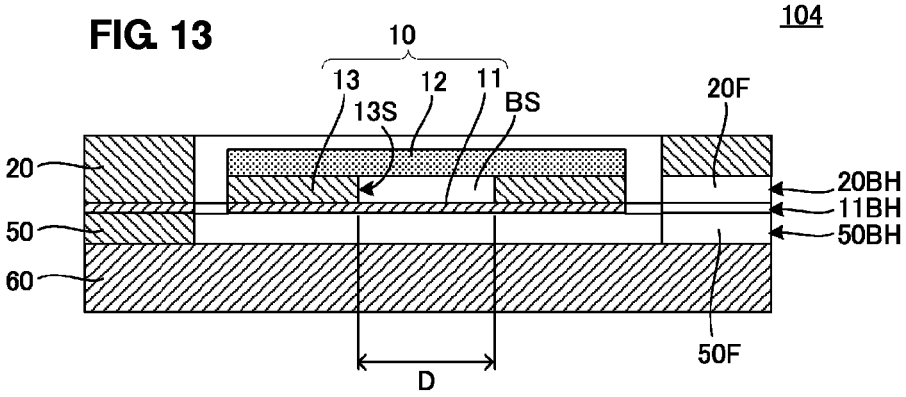
FIG. 13 is a cross-sectional view of a piezoelectric micro-blower 104 according to a fourth preferred embodiment of the present invention.

FIG. 13 is a cross-sectional view of a piezoelectric micro-blower 104 according to a fourth preferred embodiment of the present invention. The piezoelectric micro-blower 104 includes the base plate 60, the flow path plate 50, the vibration plate assembly 10, and the side wall plate 20. The vibration plate assembly 10 includes the piezoelectric element 12, the diaphragm 11, and the intermediate plate 13.

The differences from the piezoelectric micro-blowers 101 to 103 according to the first to third preferred embodiments are the configurations of the vibration plate assembly 10 and the blower chamber BS.

The vibration plate assembly 10 is sandwiched, at the periphery of the diaphragm 11, between the flow path plate 50 and the side wall plate 20. In other words, the diaphragm 11 is supported by the flow path plate 50 and the side wall plate 20. The flow path plate 50 and the side wall plate 20 correspond to a "diaphragm supporting unit" according to a preferred embodiment of the present invention.

The intermediate plate 13 corresponds to a "blower chamber frame" according to a preferred embodiment of the present invention. The piezoelectric element 12 preferably has a disk shape, whereas the intermediate plate 13 preferably has an annular shape. The intermediate plate 13 is sandwiched between the diaphragm 11 and the piezoelectric element 12. With this structure, the blower chamber BS is defined by the diaphragm 11, the piezoelectric element 12, and the intermediate plate.

The intermediate plate 13 is provided with an outlet flow path 13F. The side wall plate 20 and the flow path plate 50 are provided with an outlet 20BH and the outlet 50BH, respectively. An outlet flow path 20F is provided between the outlet 20BH and a position on a line extending from the outlet flow path 13F.

The flow path plate 50, the diaphragm 11, and the side wall plate 20 are provided with holes (not shown) which are opened to allow screws to pass therethrough. The base plate 60 is provided with threaded holes (not shown) into which screws are screwed. The base plate 60, the flow path plate 50, the diaphragm 11, and the side wall plate 20 are integrated preferably by screwing screws from the side wall plate 20 into the threaded holes of the base plate 60.

Figure 14A:
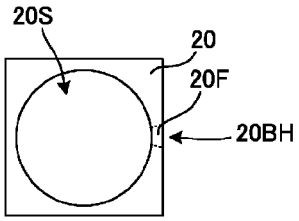
FIGS. 14A-14F is a plan view of each component member of the piezoelectric micro-blower 104 illustrated in FIG. 13.

FIGS. 14A-14F are plan views of each component member of the piezoelectric micro-blower 104 illustrated in FIG. 13. As illustrated in FIG. 14A, the side wall plate 20 preferably is square-shaped and includes the circular opening 20S in the center thereof. The side wall plate 20 includes the outlet flow path 20F, which allows communication between the opening 20S and the outlet 20BH.

Figure 14E:
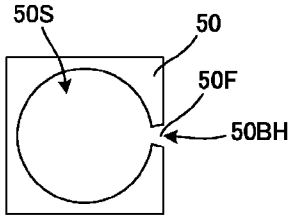
Figure 14B:
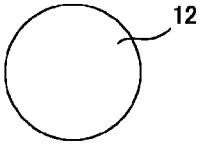

As illustrated in FIG. 14B, the piezoelectric element 12 preferably has a disk shape.

Figure 14F:
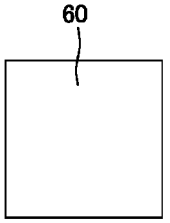
Figure 14C:
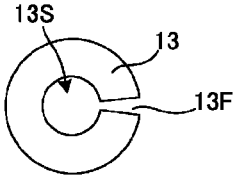

As illustrated in FIG. 14C, the intermediate plate 13 having an annular shape is provided with a slit, which defines the outlet flow path 13F described above.

Figure 14D:
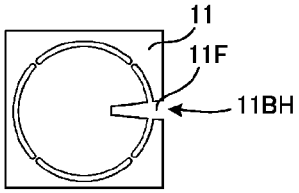

As illustrated in FIG. 14D, the diaphragm 11 preferably is square shaped and is internally provided with a plurality of arc-shaped slits. The diaphragm 11 includes an outlet flow path 11F which connects to an outlet 11BH at the opening thereof.

As illustrated in FIG. 14E, the flow path plate 50 preferably is square plate-shaped and includes a circular opening 50S in the center thereof. The flow path plate 50 includes the outlet flow path 50F, which allows communication between the opening 50S and the outlet 50BH.

As illustrated in FIG. 14F, the base plate 60 preferably is square plate-shaped.

The piezoelectric micro-blower 104 illustrated in FIG. 13 can be obtained by stacking the component members illustrated in FIGS. 14A-14F and fastening them with screws.

The blower chamber BS defined by the diaphragm 11, the piezoelectric element 12, and the intermediate plate, as described above, is in a floating state by being supported by the diaphragm 11. This allows the diaphragm 11 and the piezoelectric element 12 to individually bend and be displaced. The dimensions of the piezoelectric element 12, the intermediate plate 13, and the diaphragm 11 are determined to provide a vibration mode in which the diaphragm 11 is displaced downward while the piezoelectric element 12 is displaced to bulge upward, or the diaphragm 11 is displaced upward while the piezoelectric element 12 is displaced to bulge downward. The frequency of the drive voltage for the piezoelectric element 12 is determined such that the piezoelectric element 12 and the diaphragm 11 vibrate in the above-described mode.

As described above, the piezoelectric element 12 and the diaphragm 11 are displaced in synchronization with each other in the direction of contraction and expansion of the blower chamber BS. This produces a larger change in the volume of the blower chamber than those in the cases of the blower chambers of the piezoelectric micro-blowers according to the first to third preferred embodiments described above. Therefore, it is possible to effectively increase the flow rate of blown-out air.

Non-limiting examples of dimensions of the piezoelectric micro-blower 104 are as follows.

Piezoelectric element 12
- Thickness: 0.1 (mm)
- Outside diameter: 9 (mm)

Intermediate plate 13
- Thickness: 0.15 (mm)
- Outside diameter: 9 (mm)
- Inside diameter: 4 (mm)

Diaphragm 11
- Thickness: 0.05 (mm)
- Outside diameter: 12 (mm)

Flow path plate 50
- Thickness: 0.5 (mm)

Base plate 60
- Thickness: 0.5 (mm)

Drive voltage applied to piezoelectric element 12
- Frequency: 21.6 kHz
- Alternating current voltage: 15 Vpp Under the conditions described above, despite the low level of drive voltage, a flow rate of about 0.22 (L/minute) was able to be achieved which is substantially the same as that in the first preferred embodiment of the present invention.

In the fourth preferred embodiment of the present invention, which does not require any component designed only for the purpose of forming the blower chamber, a reduction in overall profile can be achieved. With the slits around a driven portion of the diaphragm 11, it is possible to suppress and prevent leakage of vibration to the flow path plate 50 and the side wall plate 20, which define a diaphragm supporting unit. Additionally, it is possible to achieve a stable operation without being affected by pressure caused by stacking the components and stress caused by mounting the piezoelectric micro-blower.

Fifth Preferred Embodiment

Figure 15:
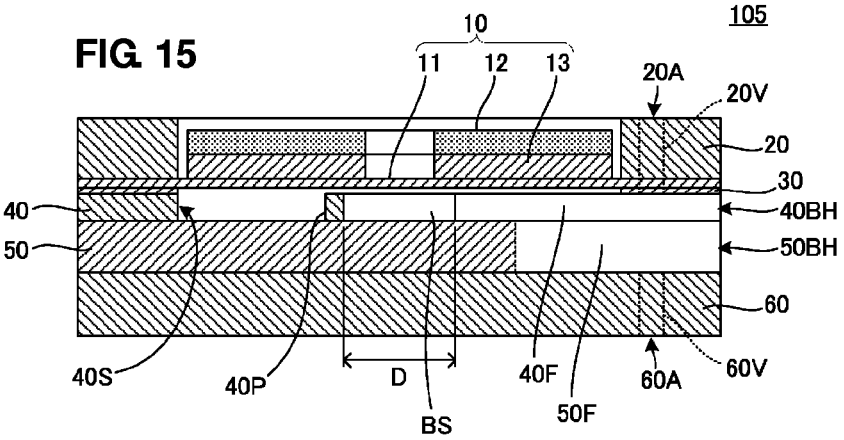
FIG. 15 is a cross-sectional view of a piezoelectric micro-blower 105 according to a fifth preferred embodiment of the present invention.

FIG. 15 is a cross-sectional view of a piezoelectric micro-blower 105 according to a fifth preferred embodiment. The difference from the piezoelectric micro-blower 101 according to the first preferred embodiment is the configuration of the blower chamber plate 40. The other configurations are preferably the same as those of the piezoelectric micro-blower 101.

In the piezoelectric micro-blower 105 according to the fifth preferred embodiment, a space defined by the diaphragm 11, the opening 40S of the blower chamber plate 40, and the flow path plate 50 is provided with a blower chamber partition 40P to divide the space. The blower chamber BS is defined by the blower chamber partition 40P and the diaphragm 11.

Figure 16A:
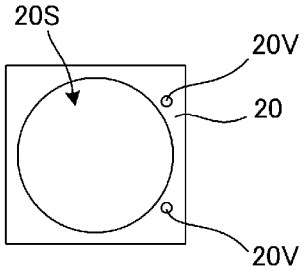
FIGS. 16A-16G is a plan view of each component member of the piezoelectric micro-blower 105 illustrated in FIG. 15.

FIGS. 16A-16G are plan views of each component member of the piezoelectric micro-blower 105 illustrated in FIG. 15. As illustrated in FIG. 16A, the side wall plate 20 preferably is square plate-shaped and includes the circular opening 20S in the center thereof. The side wall plate 20 includes two vertical holes 20V.

Figure 16B:
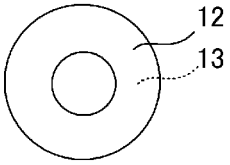

As illustrated in FIG. 16B, both the piezoelectric element 12 and the intermediate plate 13 preferably are annular plate-shaped.

Figure 16C:
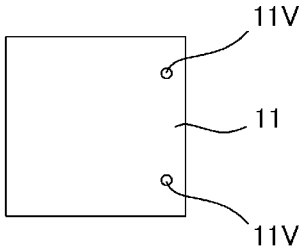

As illustrated in FIG. 16C, the diaphragm 11 preferably is square plate-shaped and includes two holes 11V, which communicate with the respective vertical holes 20V of the side wall plate.

Figure 16D:
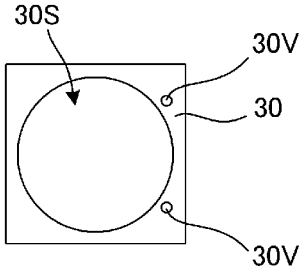

As illustrated in FIG. 16D, the spacer 30 preferably is square plate-shaped and includes the circular opening 30S in the center thereof. The spacer 30 includes two holes 30V.

Figure 16E:
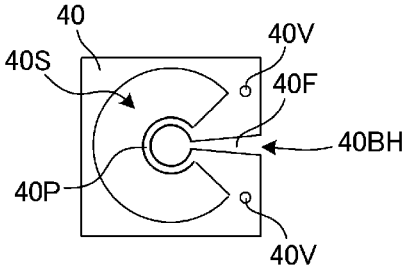

As illustrated in FIG. 16E, the blower chamber plate 40 preferably is square plate-shaped and includes the circular opening 40S in the center thereof. The blower chamber partition 40P is provided in the opening 40S. The blower chamber plate 40 has the outlet 40BH and the outlet flow path 40F. The outlet flow path 40F allows communication between the space surrounded by the blower chamber partition 40P and the outlet 40BH.

Figure 16F:
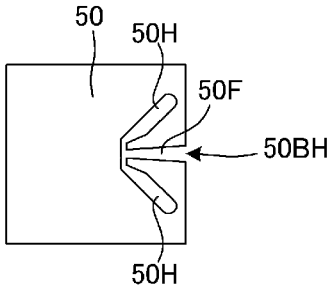

As illustrated in FIG. 16F, the flow path plate 50 preferably is square plate-shaped and includes two horizontal holes 50H and the outlet flow path 50F. First ends of the respective horizontal holes 50H connect to a base portion of the outlet flow path 50F. Second ends of the respective horizontal holes 50H communicate with the respective holes 40V of the blower chamber plate 40. The holes 40V of the blower chamber plate 40 communicate with the respective holes 30V of the spacer 30, with the respective holes 11V of the diaphragm 11, and with the respective vertical holes 20V of the side wall plate 20. This means that the second ends of the horizontal holes 50H communicate with the respective inlets 20A illustrated in FIG. 15.

Figure 16G:
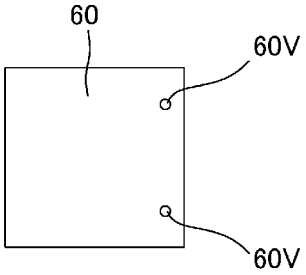

As illustrated in FIG. 16G, the base plate 60 preferably is square plate-shaped and includes two vertical holes 60V, which communicate with the respective horizontal holes 50H of the flow path plate 50.

The piezoelectric micro-blower 105 illustrated in FIG. 15 can be obtained by stacking the component members illustrated in FIGS. 16A-16G and fastening them with screws.

Although the blower chamber partition is provided in the diaphragm supporting unit in the example described above, the blower chamber partition may be provided in the diaphragm 11.

As described in the first to fourth preferred embodiments, when the blower chamber is preferably formed by providing the blower chamber plate 40 in an area where the diaphragm 11 is displaced, air resistance caused by displacement of the diaphragm 11 may hinder the displacement of the diaphragm 11. In the fifth preferred embodiment, the opening 40S of the blower chamber plate 40 is large and the space defined by the opening is internally provided with the blower chamber partition 40P. Thus, since a space for displacement can be fixed under the diaphragm 11, it becomes less likely that the displacement will be hindered. This effect will be particularly significant when the blower chamber partition 40P is disposed at a position corresponding to nodes of vibration of the diaphragm 11, and also when the diameter D of the blower chamber is small.

Sixth Preferred Embodiment

Figure 17:
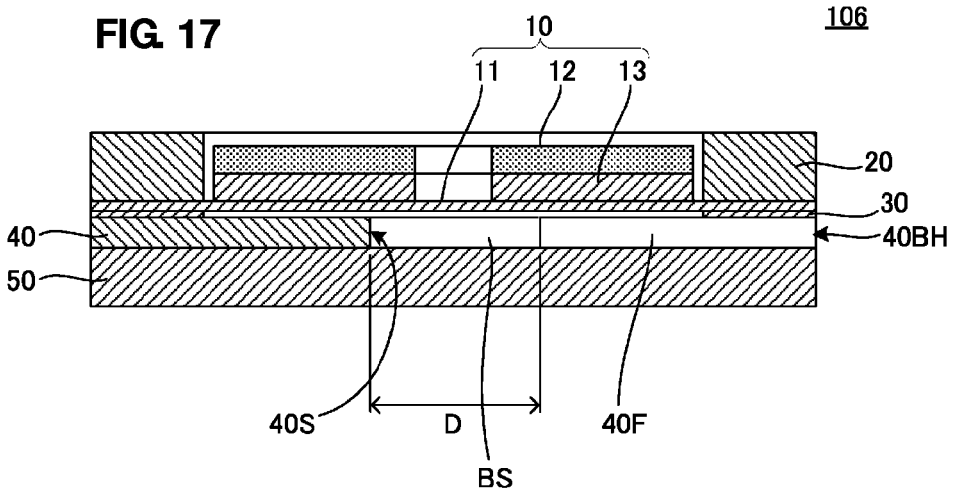
FIG. 17 is a cross-sectional view of a piezoelectric micro-blower 106 according to a sixth preferred embodiment of the present invention.

FIG. 17 is a cross-sectional view of a piezoelectric micro-blower 106 according to a sixth preferred embodiment of the present invention. The differences from the piezoelectric micro-blower 101 according to the first preferred embodiment are that the piezoelectric micro-blower 106 does not include the base plate 60 illustrated in FIG. 3, the piezoelectric micro-blower 106 does not have the vertical holes 20V and 60V illustrated in FIG. 3, the diaphragm 11 and the spacer 30 of the piezoelectric micro-blower 106 do not have holes that communicate with the vertical holes 20V, and the piezoelectric micro-blower 106 is not provided with the outlet flow path 50F illustrated in FIG. 3.

Due to the absence of inlets in the piezoelectric micro-blower 106, it is not possible to convey fluid, such as air, in one direction from an inlet to an outlet. Instead, a "bellows action" is performed in which air drawn through the outlet 40BH into the blower chamber BS is blown out of the blower chamber BS and discharged together with air around the outlet 40BH.

Since an air flow or disturbance produced by this bellows action may improve cooling efficiency, the piezoelectric micro-blower 106 can be used for cooling in small devices.

Because of the absence of the base plate, the piezoelectric micro-blower 106 of the sixth preferred embodiment can be lower in profile and simpler in configuration than the piezoelectric micro-blower 101 of the first preferred embodiment.

Seventh Preferred Embodiment

Figure 18:
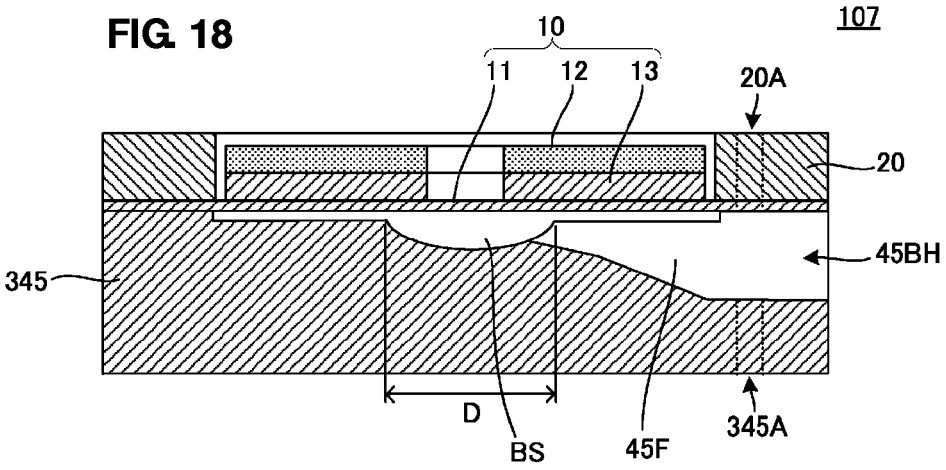
FIG. 18 is a cross-sectional view of a piezoelectric micro-blower 107 according to a seventh preferred embodiment of the present invention.

FIG. 18 is a cross-sectional view of a piezoelectric micro-blower 107 according to a seventh preferred embodiment. In the preferred embodiments described above, plate-shaped members, such as the spacer 30, the blower chamber plate 40, the flow path plate 50, and the base plate 60, are stacked to define a micro-blower. However, in the seventh preferred embodiment, a component member integrally formed by processing, such as resin molding or machining, is preferably used to form the piezoelectric micro-blower 107.

In the piezoelectric micro-blower 107 according to the seventh preferred embodiment, a lower plate 345, which is a single resin member, is a component member that corresponds to, for example, the spacer 30, the blower chamber plate 40, the flow path plate 50, and the base plate 60 illustrated in FIG. 15. The lower plate 345 includes a recessed portion. The blower chamber BS is defined by the recessed portion of the lower plate 345 and the diaphragm 11. The lower plate 345 includes a horizontal hole 45BH and an outlet flow path 45F. The lower plate 345 also includes an inlet 345A.

The vibration plate assembly 10 is an integral unit preferably formed by attaching the piezoelectric element 12 to the diaphragm 11, with the intermediate plate 13 interposed therebetween. The other configurations are preferably the same as those illustrated in FIG. 15.

When the blower body is defined by an integrally-molded resin member, the blower chamber can be easily processed into any shape. For example, the blower chamber may be tapered or rounded at a corner adjacent to the flow path, or may be formed into a dome shape to conform to the deformed shape of the diaphragm, so that a uniform change in pressure in the blower chamber can be achieved. In this case, although the blower chamber is not uniform in shape in the thickness direction, the maximum size D in the width direction can be used as the size of the blower chamber.

Like the blower chamber, the outlet flow path can be formed into any shape. By forming the outlet flow path into a shape most appropriate for flow, an improvement in performance can be achieved.

Other Preferred Embodiments

To prevent significant audible noise, the drive frequency of the piezoelectric micro-blower is preferably in an ultrasonic frequency range. The higher the drive frequency, the larger the number of cycles of vibration of the diaphragm per unit time and the higher the flow rate. Depending on the design of the resonance frequency of the vibration plate assembly, the drive frequency of the piezoelectric micro-blower may be in a barely audible frequency range of about 15 kHz or higher or in an ultrasonic frequency range (about 20 kHz or higher), or may be slightly different from such a frequency range.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A piezoelectric micro-blower comprising:

a piezoelectric element;

a diaphragm to which the piezoelectric element is attached;

a diaphragm supporting unit configured to support a periphery of the diaphragm and including a principal surface parallel or substantially parallel to a principal surface of the diaphragm and side surfaces extending perpendicular or substantially perpendicular to the principal surface of the diaphragm; and a blower chamber configured to change in volume in response to bending of the diaphragm caused by application of a voltage to the piezoelectric element, the piezoelectric micro-blower being configured to allow compressive fluid to be conveyed by the change in volume of the blower chamber; wherein one of the side surfaces of the diaphragm supporting unit is provided with an outlet that communicates with the blower chamber;

the outlet is open to a side surface of the blower chamber;

the blower chamber is sized to allow internal pressure to be substantially uniformly changed by vibration of the diaphragm in a state in which the piezoelectric element is driven by an alternating voltage of about 15 kHz or higher;

the diaphragm supporting unit includes an inlet flow path configured to draw the compressive fluid into the blower chamber and an outlet flow path configured to blow the compressive fluid out from the blower chamber to the outlet; and at least a portion of the inlet flow path and at least a portion of the outlet flow path are defined by a common path.

2. The piezoelectric micro-blower according to claim 1, wherein the blower chamber is located between the diaphragm and the diaphragm supporting unit.

3. The piezoelectric micro-blower according to claim 2, wherein at least one of the diaphragm and the diaphragm supporting unit is provided with a blower chamber partition configured to divide a space between the diaphragm and the diaphragm supporting unit; and the blower chamber is defined by a space surrounded by the diaphragm, the diaphragm supporting unit, and the blower chamber partition.

4. The piezoelectric micro-blower according to claim 2, wherein the diaphragm supporting unit is internally provided with an outlet flow path which allows communication between the outlet and the blower chamber, the diaphragm supporting unit includes an inlet, and an inlet flow path is provided which allows communication between the inlet and the middle of the outlet flow path.

5. The piezoelectric micro-blower according to claim 4, wherein the outlet and the outlet flow path define a nozzle.

6. The piezoelectric micro-blower according to claim 1, further comprising a blower chamber frame between the diaphragm and the piezoelectric element, wherein the blower chamber is defined by a space surrounded by the diaphragm, the piezoelectric element, and the blower chamber frame.

7. The piezoelectric micro-blower according to claim 6, wherein the diaphragm supporting unit is internally provided with an outlet flow path which allows communication between the outlet and the blower chamber, the diaphragm includes an inlet, and an inlet flow path is provided which allows communication between the inlet and the middle of the outlet flow path.

8. The piezoelectric micro-blower according to claim 1, wherein a size of the blower chamber in a width direction is smaller than a vibrating region of the diaphragm.

9. The piezoelectric micro-blower according to claim 1, wherein a size of the blower chamber in a width direction is less than about half a wavelength of a pressure wave at a drive frequency of the diaphragm.

10. The piezoelectric micro-blower according to claim 1, wherein a size of the blower chamber in a width direction is less than or equal to about a quarter of a wavelength of a pressure wave at a drive frequency of the diaphragm.

11. A piezoelectric micro-blower comprising:

a piezoelectric element;

a diaphragm to which the piezoelectric element is attached;

a diaphragm supporting unit configured to support a periphery of the diaphragm and including first and second principal surfaces that are opposed to each other and that are parallel or substantially parallel to a principal surface of the diaphragm and side surfaces extending between the first and second principal surfaces; and a blower chamber configured to change in volume in response to bending of the diaphragm caused by application of a voltage to the piezoelectric element, the piezoelectric micro-blower being configured to allow compressive fluid to be conveyed by the change in volume of the blower chamber; wherein one of the side surfaces of the diaphragm supporting unit is provided with an outlet that communicates with the blower chamber;

the outlet is open to a side surface of the blower chamber;

the blower chamber is sized to allow internal pressure to be substantially uniformly changed by vibration of the diaphragm in a state in which the piezoelectric element is driven by an alternating voltage of about 15 kHz or higher;

the diaphragm supporting unit includes an inlet flow path configured to draw the compressive fluid into the blower chamber and an outlet flow path configured to blow the compressive fluid out from the blower chamber to the outlet; and at least a portion of the inlet flow path and at least a portion of the outlet flow path are defined by a common path.

12. The piezoelectric micro-blower according to claim 11, wherein the blower chamber is located between the diaphragm and the diaphragm supporting unit.

13. The piezoelectric micro-blower according to claim 12, wherein at least one of the diaphragm and the diaphragm supporting unit is provided with a blower chamber partition configured to divide a space between the diaphragm and the diaphragm supporting unit; and the blower chamber is defined by a space surrounded by the diaphragm, the diaphragm supporting unit, and the blower chamber partition.

14. The piezoelectric micro-blower according to claim 12, wherein the diaphragm supporting unit is internally provided with an outlet flow path which allows communication between the outlet and the blower chamber, the diaphragm supporting unit includes an inlet, and an inlet flow path is provided which allows communication between the inlet and the middle of the outlet flow path.

15. The piezoelectric micro-blower according to claim 14, wherein the outlet and the outlet flow path define a nozzle.

16. The piezoelectric micro-blower according to claim 11, further comprising a blower chamber frame between the diaphragm and the piezoelectric element, wherein the blower chamber is defined by a space surrounded by the diaphragm, the piezoelectric element, and the blower chamber frame.

17. The piezoelectric micro-blower according to claim 16, wherein the diaphragm supporting unit is internally provided with an outlet flow path which allows communication between the outlet and the blower chamber, the diaphragm includes an inlet, and an inlet flow path is provided which allows communication between the inlet and the middle of the outlet flow path.

18. The piezoelectric micro-blower according to claim 11, wherein a size of the blower chamber in a width direction is smaller than a vibrating region of the diaphragm.

19. The piezoelectric micro-blower according to claim 11, wherein a size of the blower chamber in a width direction is less than about half a wavelength of a pressure wave at a drive frequency of the diaphragm.

20. The piezoelectric micro-blower according to claim 11, wherein a size of the blower chamber in a width direction is less than or equal to about a quarter of a wavelength of a pressure wave at a drive frequency of the diaphragm.

* * * * *